US011333138B2

(12) United States Patent
Wu

(10) Patent No.: US 11,333,138 B2
(45) Date of Patent: May 17, 2022

(54) THREE-STAGE COMPRESSION AIR PUMP

(71) Applicant: Scott Wu, Taichung (TW)

(72) Inventor: Scott Wu, Taichung (TW)

( * ) Notice: Subject to any disclaimer, the term of this patent is extended or adjusted under 35 U.S.C. 154(b) by 0 days.

(21) Appl. No.: 17/088,827

(22) Filed: Nov. 4, 2020

(65) Prior Publication Data

US 2021/0254610 A1 Aug. 19, 2021

(30) Foreign Application Priority Data

Feb. 14, 2020 (TW) ..... 109104806

(51) Int. Cl.

| | |
|---|---|
| ***F04B 33/00*** | (2006.01) |
| ***F04B 39/12*** | (2006.01) |
| ***F04B 25/00*** | (2006.01) |
| *F04B 37/12* | (2006.01) |

(52) U.S. Cl.

CPC ..... *F04B 33/00* (2013.01); *F04B 25/005* (2013.01); *F04B 39/123* (2013.01); *F04B 37/12* (2013.01)

(58) Field of Classification Search

CPC ..... F04B 25/005; F04B 33/00; F04B 33/005; F04B 39/10; F04B 39/12; F04B 39/123; F04B 53/02; F04B 53/14; F04B 53/16

See application file for complete search history.

(56) References Cited

U.S. PATENT DOCUMENTS

| | | | | |
|---|---|---|---|---|
| 5,676,529 | A * | 10/1997 | Hermansen | F04B 33/005 417/259 |
| 8,025,491 | B2 * | 9/2011 | Wang | F04B 33/005 417/468 |
| 2019/0348239 | A1 | 11/2019 | Chu | |
| 2020/0300232 | A1 * | 9/2020 | Wang | F04B 39/0016 |
| 2020/0300239 | A1 * | 9/2020 | Wang | F04B 39/121 |

FOREIGN PATENT DOCUMENTS

| | | | | |
|---|---|---|---|---|
| CN | 103925188 | A * | 7/2014 | F04B 33/00 |

* cited by examiner

*Primary Examiner* — Charles G Freay
*Assistant Examiner* — Chirag Jariwala
(74) *Attorney, Agent, or Firm* — Karin L. Williams; Alan D. Kamrath; Mayer & Williams PC

(57) ABSTRACT

A three-stage compression air pump includes a pump head and a pumping device. The pumping device includes first and second cylinders and a plunger. The first cylinder is connected with the pump head and coupled to a first piston moving in the second cylinder. The second cylinder includes a first end cap and a second end cap respectively coupled to the two ends thereof. The first cylinder is inserted through the first end cap. The second end cap defines an orifice allowing outside air to flow into the second cylinder and includes a one-way valve preventing the air in the second cylinder from flowing outside the three-stage compression pump. The plunger is inserted in and movably coupled to the first cylinder and coupled to a second piston moving in the first cylinder and connected with the second end cap. The plunger is inserted through the first piston.

10 Claims, 4 Drawing Sheets

THREE-STAGE COMPRESSION AIR PUMP

BACKGROUND OF THE INVENTION

1. Field of the Invention

The present invention relates to an air pump and, particularly, to a three-stage compression air pump.

2. Description of the Related Art

TW Pat. No. I645111 discloses a variable-pressure air pump, which includes a first cylinder, a second cylinder, a first air pipe, a piston set, a connecting device, and a discharging device. The first cylinder, the second cylinder and the first air pipe are arranged coaxially and can move relative to one another in an axial direction. The piston set can compress the air in the first cylinder and selectively compress the air in the second cylinder. Thus, the air pump can have different pumping modes which supplies air at different pressures. The connecting device is disposed in the first cylinder and suitable for connecting an object to be inflated. The discharging device includes a connecting member and a switch. The connecting member is connected to the second cylinder and has a discharge hole communicating with the second cylinder. The switch is connected to the connecting piece and has an air guiding groove that selectively communicates with the discharge hole and the outside. The air pump is convertible between a first mode for outputting high-volume air in which the first and the second cylinders move relative to one another and a second mode for outputting high-pressure air in which the second cylinder does not move relative to the first cylinder to output high-pressure air.

The air pump is a two-stage compression air pump and still has some shortcomings.

The present invention is, therefore, intended to obviate or at least alleviate the problems encountered in the prior art.

SUMMARY OF THE INVENTION

According to the present invention, a three-stage compression air pump includes a pump head and a pumping device fluidly connected with the pump head. The pumping device includes a first cylinder, a second cylinder and a plunger. The first cylinder has a first end connected with the pump head and a second end coupled to a first piston. The first cylinder is inserted in the second cylinder. The second cylinder is movably coupled to the first cylinder such that the first piston moves in the second cylinder in response to movement of the second cylinder with respect to the first cylinder. The second cylinder includes a first end cap and a second end cap respectively coupled to two ends thereof. The first cylinder is inserted through the first end cap. The second end cap defines an orifice allowing air outside of the three-stage compression air pump to flow into the second cylinder and includes a one-way valve disposed thereon preventing the air in the second cylinder from flowing outside the three-stage compression pump. The plunger is inserted in and movably coupled to the first cylinder and has a first end coupled to a second piston and a second end connected with the second end cap. The second piston moves in the first cylinder in response to the movement of the plunger with respect to the first cylinder. The plunger is inserted through the first piston.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objectives, advantages, and new features of the present invention will become apparent from the following detailed description of the invention when considered in conjunction with the accompanied drawings.

DETAILED DESCRIPTION OF THE INVENTION

Figure 1:
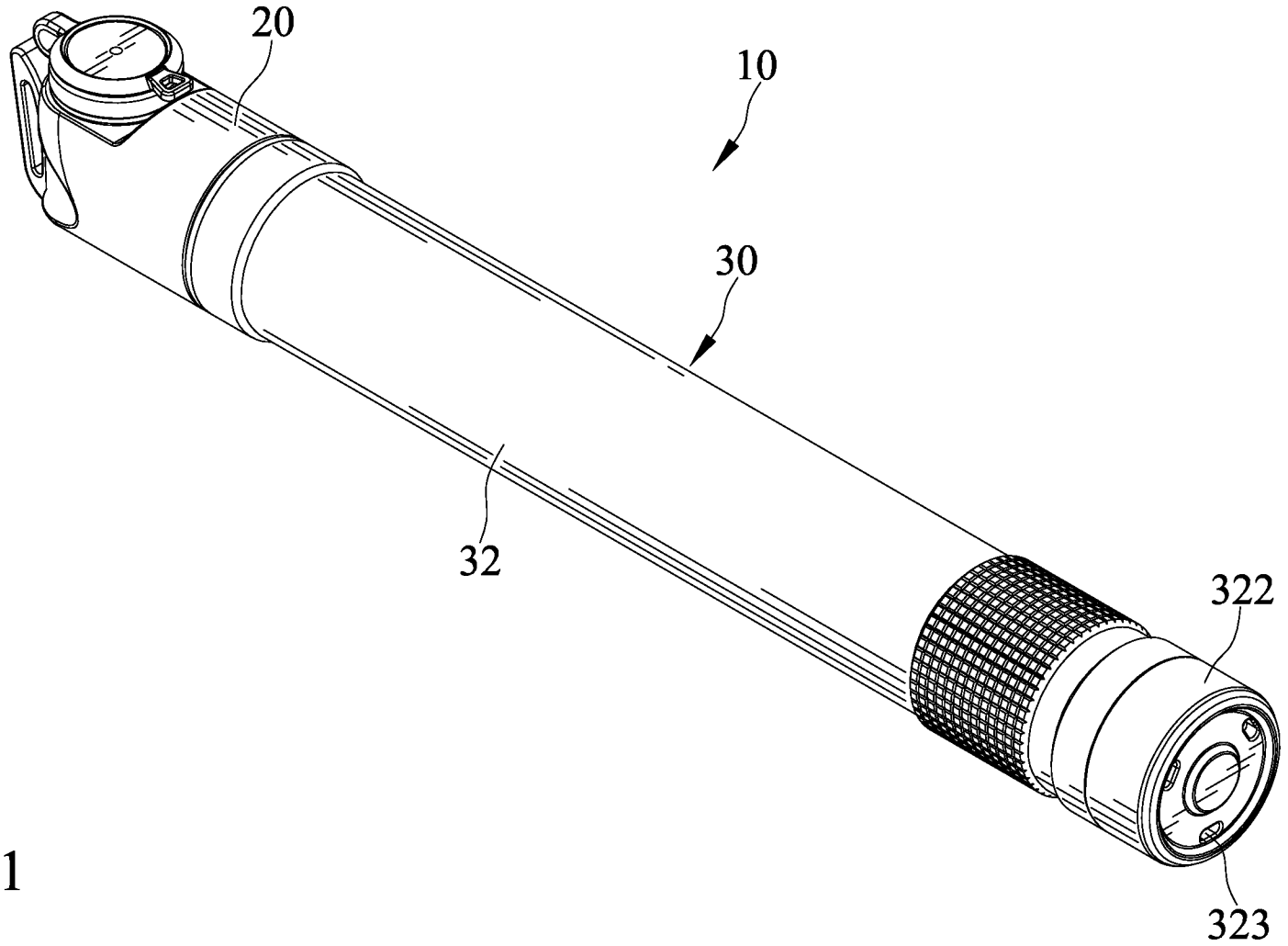
FIG. 1 is a perspective view of a three-stage compression air pump in accordance with the present invention.
Figure 2:
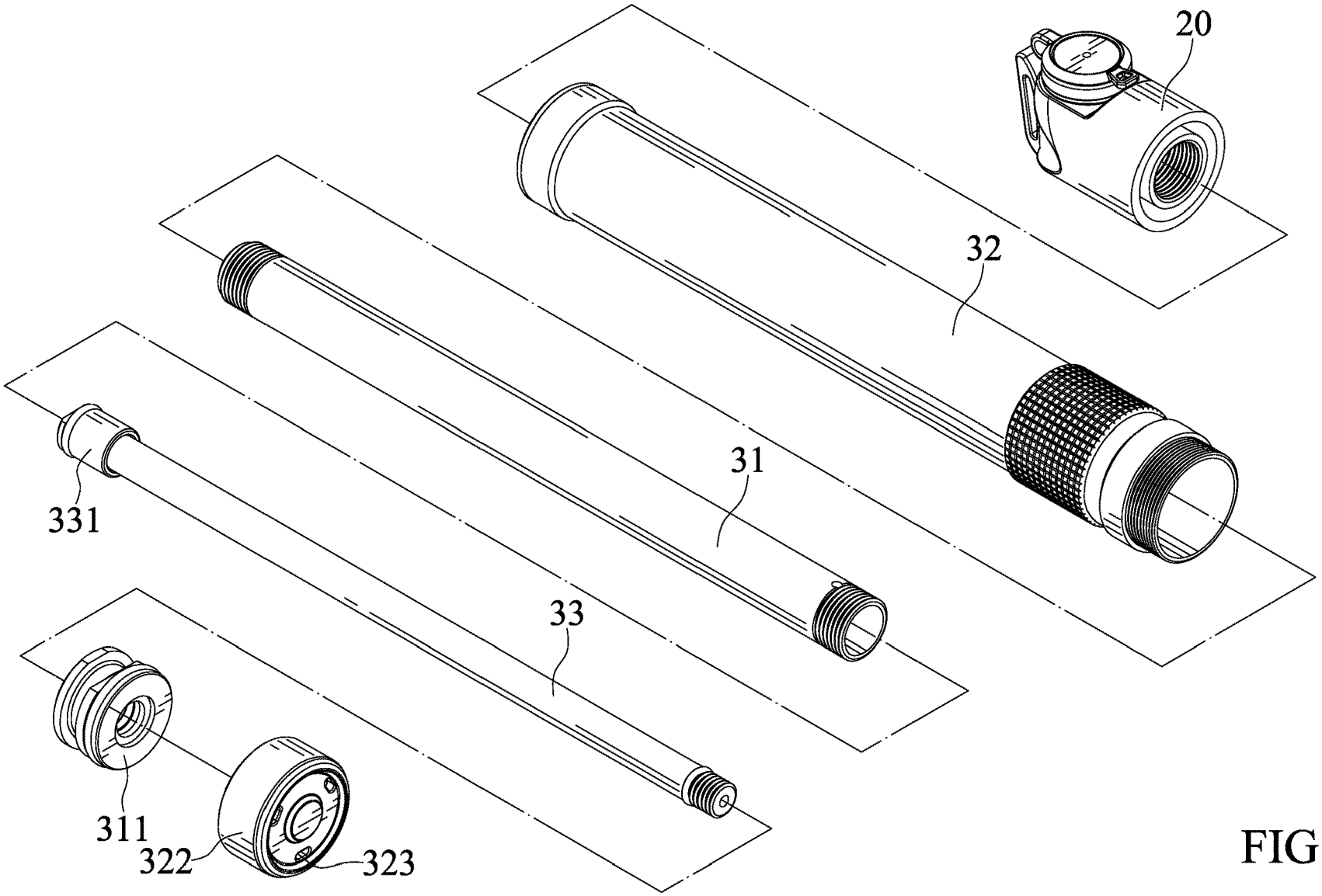
FIG. 2 is an exploded perspective view of the three-stage compression air pump of the present invention.
Figure 3:
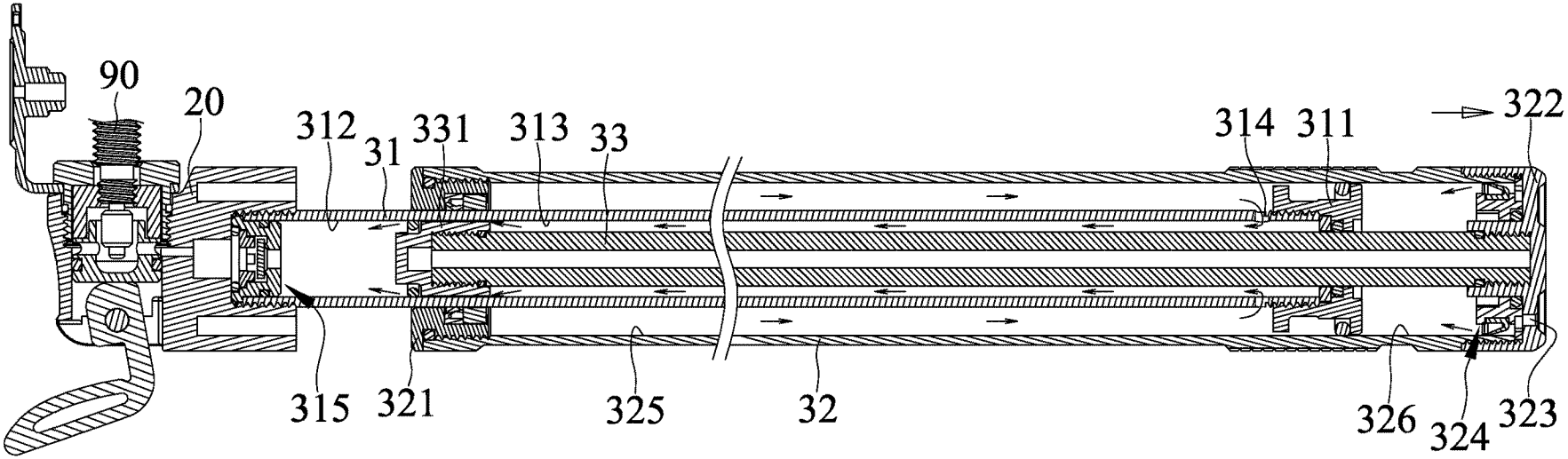
FIG. 3 is a cross-sectional view showing the three-stage compression air pump of the present invention stroked in a first position and air flows represented by arrows.
Figure 4:
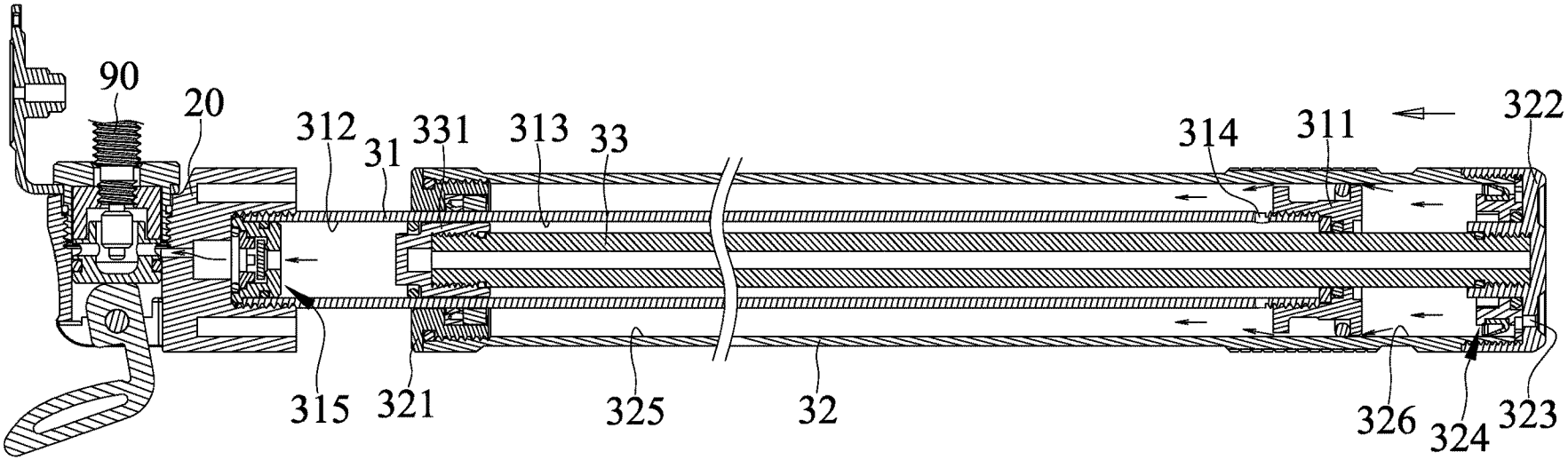
FIG. 4 is a cross-sectional view showing the three-stage compression air pump of the present invention stroked in a second position and air flows represented by arrows.

FIGS. 1 through 4 show a three-stage compression air pump 10 in accordance with the present invention. The air pump 10 includes a pump head 20 and a pumping device 30 fluidly connected with the pump head 20. The pump head 20 is configured to engage with a valve 90 of an object to be inflated by the three-stage compression air pump 10. The pumping device 30 is operable and configured to compress air, which will flow to the pump head 20 and into the valve 90 of the object to be inflated thereafter.

The pumping device 30 is operable manually. The pumping device 30 includes a first cylinder 31, a second cylinder 32, and a plunger 33.

The first cylinder 31 has a first end connected with the pump head 20 and a second end coupled to a first piston 311.

The first cylinder 31 is inserted in the second cylinder 32. The first cylinder 31 and the pump head 20 are incorporated with a non-return valve 315 such that air is prevented from flowing from the pump head 20 into the first cylinder 31.

The second cylinder 32 is movably coupled to the first cylinder 31 such that the first piston 311 moves in the second cylinder 32 in response to movement of the second cylinder 32 with respect to the first cylinder 31. Thus, the first piston 311 compresses air in the second cylinder 32. The second cylinder 32 has an outer periphery forming a grip adapted to be grasped when operating the three-stage compression air pump 10, i.e. moving the second cylinder 32 with respect to the first cylinder 31.

Further, the second cylinder 32 includes a first end cap 321 and a second end cap 322 respectively coupled to two ends thereof. The first cylinder 31 is inserted through the first end cap 321. The second end cap 322 defines an orifice 323 allowing air outside of the three-stage compression air pump 10 to flow into the second cylinder 32. The orifice 323 opens to outside of the three-stage compression air pump 10 and the second cylinder 32. The second end cap 322 also includes a one-way valve 324 disposed thereon preventing the air in the second cylinder 32 from flowing outside the three-stage compression pump 10.

Further, the second cylinder 32 includes a first interior section 325 and a second interior section 326. The first interior section 325 extends between the first end cap 321 and the first piston 311. The second interior section 326 extends between the second end cap 322 and the first piston 311. The first interior section 325 is fluidly communicable with the second interior section 326 such that when the second cylinder 32 is stroked in a first direction away from the first cylinder 31, air is urged from the first interior section 325 into the first cylinder 31 and such that when the second cylinder 32 is stroked in a second direction opposite to the first direction, air is urged from the second interior section 326 into the first interior section 325. Specifically, the first cylinder 31 includes a hole 314 extending therethrough radially and opening to the first interior section 325 and the first cylinder 31, thereby allowing air to flow from the first interior section 325 into the first cylinder 31.

The plunger 33 is inserted in and movably coupled to the first cylinder 31. Specifically, the plunger 33 moves relative to the first cylinder 31 in response to movement of the second cylinder 32 with respect to the first cylinder 31. Thus, the plunger 33 and the second cylinder 32 move reciprocally together with respect to the first cylinder 31 upon the operation of the three-stage compression air pump 10.

The plunger 33 has a first end coupled to a second piston 331 and a second end connected with the second end cap 322. The second piston 331 moves in the first cylinder 31 in response to the movement of the plunger 33 with respect to the first cylinder 31 and is configured to compress air in the first cylinder 31. Further, the plunger 33 is inserted through the first piston 311.

Additionally, the first cylinder 31 includes a third interior section 312 extending between the first end of the first cylinder 31 and the second piston 331 and a fourth interior section 313 extending between the second piston 331 and the second end of the first cylinder 31. The third interior section 312 is fluidly communicable with the fourth interior section 313 such that when the second cylinder 32 is stroked in the first direction, air is urged from the fourth interior section 313 into the third interior section 312 and such that when the second cylinder 32 is stroked in the second direction, air is urged from the third interior section 312 into the pump head 20.

In view of the forgoing, the three-stage compression air pump 10 can output high-pressure air easily and quickly, which is compressed by the first and the second pistons 311 and 331. Particularly, when the second cylinder 32 is stroked in the first direction away from the first cylinder 31, the air outside of the three-stage compression air pump 10 is introduced into the second cylinder 32 and retained therein, i.e. the second interior section 326. Then, the air is compressed by the first piston 311 to accomplish two stages of a three-stage compression. Finally, the air is compressed by the second piston 331 to accomplish the last stage of the three-stage compression.

The foregoing is merely illustrative of the principles of this invention, and various modifications can be made by those skilled in the art without departing from the scope and spirit of the invention.

What is claimed is:

1. A three-stage compression air pump comprising:

a pump head; and a pumping device fluidly connected with the pump head and including a first cylinder, a second cylinder and a plunger, wherein the first cylinder has a first end connected with the pump head and a second end coupled to a first piston, wherein the first cylinder is inserted in the second cylinder, wherein the second cylinder is movably coupled to the first cylinder such that the first piston moves in the second cylinder in response to movement of the second cylinder with respect to the first cylinder, wherein the second cylinder includes a first end cap and a second end cap respectively coupled to two ends thereof, wherein the first cylinder is inserted through the first end cap, wherein the second end cap defines an orifice allowing air outside of the three-stage compression air pump to flow into the second cylinder and includes a one-way valve disposed thereon preventing the air in the second cylinder from flowing outside the three-stage compression pump, wherein the plunger is inserted in and movably coupled to the first cylinder and has a first end coupled to a second piston and a second end connected with the second end cap, wherein the plunger is hollow and sealed, and the air in the second cylinder does not flow into the plunger, wherein the second piston moves in the first cylinder in response to the movement of the plunger with respect to the first cylinder, and wherein the plunger is inserted through the first piston.

2. The three-stage compression air pump as claimed in claim 1, wherein the plunger moves relative to the first cylinder in response to the movement of the second cylinder with respect to the first cylinder.

3. The three-stage compression air pump as claimed in claim 2, wherein the second cylinder includes a first interior section extending between the first end cap and the first piston and a second interior section extending between the second end cap and the first piston, and wherein the first interior section is fluidly communicable with the second interior section such that when the second cylinder is stroked in a first direction away from the first cylinder, the air is urged from the first interior section into the first cylinder and such that when the second cylinder is stroked in a second direction opposite to the first direction, the air is urged from the second interior section into the first interior section.

4. The three-stage compression air pump as claimed in claim 3, wherein the first cylinder includes a third interior section extending between the first end of the first cylinder and the second piston and a fourth interior section extending between the second piston and the second end of the first cylinder, and wherein the third interior section is fluidly communicable with the fourth interior section such that when the second cylinder is stroked in the first direction, the air is urged from the fourth interior section into the third interior section and such that when the second cylinder is stroked in the second direction, the air is urged from the third interior section into the pump head.

5. The three-stage compression air pump as claimed in claim 3, wherein the first cylinder includes a hole extending therethrough radially and opening to the first interior section and the first cylinder, thereby allowing the air to flow from the first interior section into the first cylinder.

6. The three-stage compression air pump as claimed in claim 4, wherein the first cylinder includes a hole extending therethrough radially and opening to the first interior section and the first cylinder, thereby allowing the air to flow from the first interior section into the first cylinder.

7. The three-stage compression air pump as claimed in claim 5, wherein the pump head and the first cylinder are incorporated with a non-return valve such that the air is prevented from flowing from the pump head into the first cylinder.

8. The three-stage compression air pump as claimed in claim 6, wherein the pump head and the first cylinder are incorporated with a non-return valve such that the air is prevented from flowing from the pump head into the first cylinder.

9. The three-stage compression air pump as claimed in claim 1, wherein the second cylinder has an outer periphery forming a grip adapted to be grasped when operating the three-stage compression air pump.

10. The three-stage compression air pump as claimed in claim 2, wherein the second cylinder and the plunger are moved reciprocally axially with respect to the first cylinder upon the operation of the three-stage compression air pump.

* * * * *